US005135566A

United States Patent [19]

Sakuranda et al.

[11] Patent Number: 5,135,566

[45] Date of Patent: Aug. 4, 1992

[54] IRON BASE POWDER MIXTURE AND METHOD

[75] Inventors: Ichio Sakuranda; Ritsuo Okabe; Takao Omura; Yoshisato Kiyota; Shigeaki Takajo, all of Chiba, Japan

[73] Assignee: Kawasaki Steel Corporation, Japan

[21] Appl. No.: 686,846

[22] Filed: Apr. 17, 1991

Related U.S. Application Data

[60] Continuation of Ser. No. 458,840, Dec. 29, 1989, Pat. No. 4,946,499, which is a division of Ser. No. 252,066, Sep. 29, 1988, abandoned.

[30] Foreign Application Priority Data

Sep. 30, 1987 [JP] Japan ..... 62-244072

[51] Int. Cl.[5] ..... B22F 1/00

[52] U.S. Cl. ..... 75/255; 75/246; 75/252

[58] Field of Search ..... 75/252, 255, 246

[56] References Cited

U.S. PATENT DOCUMENTS

| | | | |
|---|---|---|---|
| 812,494 | 2/1906 | Hussey | 75/252 |
| 2,473,019 | 6/1949 | Erasmus | 75/252 |
| 2,882,589 | 4/1959 | Stafford | 75/252 |
| 4,002,474 | 1/1977 | Blachford | 419/36 |
| 4,246,028 | 1/1981 | Lynn | 75/252 |
| 4,251,599 | 2/1981 | McCormick | 75/252 |
| 4,504,441 | 3/1985 | Kuyper | 419/35 |
| 4,758,272 | 7/1988 | Pierotti et al. | 75/246 |

FOREIGN PATENT DOCUMENTS

| | | |
|---|---|---|
| 1255603 | 10/1989 | Japan . |
| 1255604 | 10/1989 | Japan . |

*Primary Examiner*—Robert Kunemund
*Assistant Examiner*—Felisa Garrett
*Attorney, Agent, or Firm*—Austin R. Miller

[57] ABSTRACT

An iron base powder mixture for powder metallurgy, comprising an iron based powder and an alloying powder and/or a powder for improving machinability, wherein the alloying powder and/or the powder for improving machinability are adhered to the surface of the ferrous powder by means of a melted-together binder composed of an oil and a metal soap or wax.

10 Claims, 15 Drawing Sheets

10μm

10μm

IRON BASE POWDER MIXTURE AND METHOD

This application is a continuation of application Ser. No. 07/458,840, filed Dec. 29, 1989, now abandoned, which is a divisional of Ser. No. 07/252,066 filed Sep. 29, 1988, now abandoned.

This invention concerns an iron base powder mixture for powder metallurgy which in normal handling undergoes little powder segregation or dust generation and has excellent flowability. The invention further relates to a method of producing the mixture.

In particular, the invention concerns a mixture of powders which contains one or more alloying powders, wherein the various particles in the mixed powder have large differences of specific gravity as between or among them. This invention effectively limits or prevents powder segregation and dust generation in and by the powder.

CONVENTIONAL TECHNOLOGY

Hitherto, iron base powder mixtures for powder metallurgy have generally been produced by a mixing method in which alloying powders such as copper, zinc, and/or ferrophosphorus powders, etc., are mixed with a lubricant such as zinc stearate. However powder mixtures produced by such mixing methods have major drawbacks since the product experiences segregation of the powders in the mixture, and is subject to dust generation in normal handling.

The problem of segregation is significant since the powder mixture contains powders having different sizes, shapes and densities.. Accordingly segregation occurs readily during transport and upon charging the powder mixture into hoppers, or during filling and compacting steps in dies or molding treatments. For example, it is well known that segregation of the graphite component of a mixture of ferrous powder and graphite powder occurs within a transport vehicle owing to vibrations during trucking, so that the graphite powder rises to the top. It is also known that the concentration of graphite powder differs at the beginning, middle, and end of the discharging operation from a hopper. These segregations cause fluctuations in the composition of the product of the powder metallurgy; fluctuations in dimensional changes and strength become large, and this causes the production of inferior products.

Graphite powder also presents an environmental problem because of excessive dust generation.

The flowability of the powder mix also decreases as a result of the increased specific surface area of the mixture, since graphite and other powders are fine powders. Such decreases in flowability are disadvantageous because they decrease the production speed of green compacts by decreasing charging speed into dies for compaction.

The aforementioned problems of segregation and dust generation can be resolved theoretically by bringing about in some way an adhesion of the ferrous powder and the alloying powder.

Methods based on selection of an appropriate binder (e.g., Japanese Kokoku Patent No. Sho 58 28321, Japanese Kokai Patent No. Sho 56-136901, or Japanese Patent Publication No. Sho 60-50218) or improvement of the flowability (Japanese Kokoku Patent No. Sho 53-16796), etc. have been proposed in the past.

These methods limit the quantity of binder, taking into consideration the flowability, apparent density and compressibility of the powder mixture and the strength of the green compact; if the quantity of binder added is increased until the binding effect of the ferrous powder and alloying powder becomes sufficiently great, the flowability of the powder mixture becomes less than that of the powder mixture obtained in a conventional mixing method.

Therefore, it is difficult to provide a powder mixture having a sufficiently great binding effect of the ferrous powder and the alloying powder while at the same time possessing excellent flowability. In addition, since the binding of the ferrous powder and the alloying powder is due to only a quantity of about 0.3% by weight or less of the binder, the problem arises that the quantity of alloying powder to be bonded and its particle dimensions are severely restricted.

These technologies do not provide adequate solutions to the problem of reduced flowability, either. At present, there is available only the negative countermeasure of selecting binders which increase the flowability of the powder to some extent when a particular binder is selected.

Moreover in the latter case the problem remains that the compactibility of the green compact is impaired since the particles of the various powders are finely crushed or pulverized.

On the other hand, the present inventors disclosed an iron base powder mixture for powder metallurgy which prevents segregation and has excellent flowability in Japanese Patent Application No. Sho 62-39078. This method was very effective in preventing segregation and improving the flowability of the mixture, but room for improvement has remained with regard to the decreases in green compact density that occur when the extent of segregation prevention rises and the fact that the lifetime of compacting dies is greatly decreased by the increase in compacting pressure.

Thus, the present situation is that there has been no iron base powder mixture for powder metallurgy capable of enjoying minimum segregation, excellent flowability and controlled dust generation without harming the properties of the powder and the green compact for which the powder is provided.

OBJECTS OF THE PRESENT INVENTION

An object of the present invention is to create an iron base powder mixture for powder metallurgy that experiences minimun segregation or dust generation and positively improves the flowability of the powder, while maintaining the properties of the powder mixture and of green compacts obtained by conventional methods.

Another object of the present invention is to provide a method of production that makes it possible to produce easily an iron base powder mixture for powder metallurgy having the advantageous and excellent properties mentioned above.

DETAILED DESCRIPTION OF THE INVENTION

We have discovered an iron base powder mixture for powder metallurgy in which the problems of the past have been overcome. This has been acheived by heat treatment while mixing after having homogeneously mixed the metallurgical powder with a melted-together binder or wax powder.

Iron base powder mixtures for powder metallurgy that have excellent flowability and little or no segregation because of effective adhesions of particles of ferrous powder and alloying powder are obtained according to the present invention.

Not only can the iron base powder mixtures for powder metallurgy which are obtained according to the present invention greatly reduce the production of poor-quality sintered machine part products, by eliminating the segregation of the alloying powder but they can also increase the compacting speed of the compacting step itself, since the resulting powder mixes have excellent flowability; this advantage is also associated with improved productivity.

Furthermore, the iron base powder mixtures of the present invention and the method of producing them have marked advantages in preventing dust generation, which contributes greatly to overcoming environmental problems.

This invention relates to a mixture of a ferrous powder and an alloying powder wherein, upon examining screened fractions of the mixture, the percentage of alloying powder contained in the 100–200 mesh residue of the mixture divided by the percentage of the same alloy element in the total mixture is 65% or above. This is a measure of the degree of adhesion of the alloying powder.

When the alloying element is carbon (C) and the melted-together binder consists of oleic acid as an oil and zinc stearate as a metal soap, the ratio of the quantity of alloying element (C) in the 100–200 mesh residue in the mixture to the quantity of said alloying element in the entire mixture (a measure of the degree of adhesion of the alloying powder) is defined by the following formulas (1) and (2):

$$\text{adhesion of } C(\%) = \frac{[C]}{[C']} \times 100 \quad (1)$$

$$\approx \frac{[c]}{[Gr] + (0.68[St] + 0.76[O])} \times 100 \quad (2)$$

where

[C] is the percentage of C in the 100–200 mesh residue of the mixture (% by weight)

[C'] is the percentage of C in the whole mixture (% by weight)

[St] is the % by weight of zinc stearate added to the mixture.

[O] is the % by weight of oleic acid added to the mixture, and

[Gr] is the % by weight of graphite powder added to the mixture

In determining percentage adhesion using the foregoing equations the treated powder is sieved to 100–200 mesh using a standard Rotap separator. The carbon powder that did no adhere to the ferrous powder surface passes through the 200 mesh screen. The ratio of the C amount of this powder (residue contained on the 200-mesh screen) to the C amount of the whole mixture is taken as indicating the degree of C adhesion.

The degree of C adhesion according to the aforementioned formula (1) or (2) is used as a simple method for evaluating the degree of segregation of the alloying powder. It was confirmed that it correlates with the actual segregation of the alloying powder as confirmed in dust generation tests and segregation tests by two-stage hopper removal as well, as will be discussed below.

The flowability of the powder may be measured according to JIS Z 2502 1979: "Method for testing flowability of metal powder."

Moreover, the powder according to this invention may be a mixture of a ferrous powder and an alloying powder and/or a silicon (Si) containing powder provided for improving machinability of the resulting sintered product. The ratios of the quantity of each alloying powder and the quantity of silicon (Si) in the 100–200 mesh residue of the powder mixture to the quantity of each alloy element and the quantity of silicon (Si) in the total mixture are 65% or more, respectively, and this is a measure of the degree of adhesion of the alloying powder of the powder for improving machinability.

Moreover, the resulting powder mixture has a flowability, as specified in JIS Z 2502-1979, which is at least 5 sec/50 g better that the flowability in the case of a simple (unheated) mixture composed of the same powders, using the same kind and quantity of lubricant. Furthermore, since dust generation is especially striking in the case in which the alloying powder contains graphite, this invention includes mixtures having quantities of accumulated dust generated of 300 counts or less within a measurement time of 240 seconds. Furthermore, it is characterized in that the density of the green compact when this mixture is compacted in a die under a pressure of $5t/cm^2$ is not reduced more than 0.04 $g/cm^2$ compared to the density of a simple mixture composed of the same powders, using the same kind and quantity of lubricant.

Moreover, this invention is an iron base powder mixture for powder metallurgy, characterized in that the alloying powder and/or the powder for improving machinability are made to adhere to the surface of the ferrous powder by means of a melt-blended binder composed of the combination of a particular oil and a metal soap or wax, melted together.

Moreover, the weight ratio of the oil which is a constituent of the melted-together binder to the metal soap or wax, which is another constituent, is 0.1–0.4, and in this case it is highly preferred for the oil to be oleic acid and the metal soap to by zinc stearate.

The aforementioned iron base powder mixture for powder metallurgy can be manufactured by the following method.

(1) one or more alloying powders and a powdered metal soap or wax are mixed with the ferrous metal powder.

(2) The selected oil such as oleic acid is added and a homogeneous mixture is made.

(3) These ingredients are heated to 90 °–150° C., either during the aforementioned mixing process (2) or after they have been mixed.

(4) Next, the mixture is cooled to 85° C. or below while mixing.

The mixture obtained in this way does not experience harmful segregation or dust generation, has excellent flowability, and also has excellent lubricating properties.

In accordance with this invention the alloying powder may be graphite powder, ferrophosphorus powder, Ni powder, Fe-Ni alloy powder, copper powder, or a copper alloy powder, for example. The term "alloy element" means, C, P, Ni, Cu, or Sn, etc., corresponding to these powders. The powder for improving machinability is a powder which is not alloyed but which improves the properties of the green compact, and includes powder such as forsterite, talc, etc.

The term "oil" refers to a vegetable or mineral oil or a fatty acid; examples include particularly oleic acid or rice-bran oil, spindle oil, etc. Oleic acid differs sharply from wood pulp byproducts such as the tall oil as described in Engstrom U.S. Pat. No. 4,676,831, in that is does not significantly react with the ferrous metal particles even when heated and coacts with a metal soap lubricant such as zinc stearate, or a wax powder, to produce a different binding operation in a different way, as will further become apparent hereinafter.

In this invention, the term "luburicant" is intended to include various lubricants generally used for powder metallurgy, such as zinc stearate or other metal soaps or wax powders, etc.

In the practice of this invention a metal soap or wax powder may be used, of the type which has been generally used in the past, and which does not harm the properties of the powders or the subsequently formulated green compact. It is important that the lubricant is melted together with the oil and this combination serves as the binding agent for the ferrous powder and the alloying powder. Consequently, in contrast to conventional methods in which a single substance such as a thermoplastic resin or tall oil, etc, is added as the binding agent, the properties of the powders in the mixture and the properties of the resulting green compact are not harmed, even when the quantity of binder added is more than doubled as compared to conventional practice.

Moreover, the adhesion of the alloying powder to the surface of the ferrous powder proved unstable in practicing the conventional methods, since only small portions of the contact surfaces of the particles were found to adhere. In contrast, with the powder mixture of this invention the quantity of the binder may be two or more times that of the conventional methods; the binder covers essentially all of the alloying powder and causes the alloying powder to adhere stably to the surface of the ferrous powder, thus minimizing or preventing segregation.

In this invention as applied to the use of graphite powder, a mixture is provided in which, in order to prevent segregation of the graphite powder (C), together with ferrophosphorus powder (P), or other additives, e.g., forsterite powder, etc. added for improving the machinability of the sintered body, and to suppress dust generation, heating is performed while mixing, after these alloying powders have been added to the ferrous powder together with the oil and the metal soap or wax powder. Thus a melt-blended binder containing the oil and the metal soap or wax powders is formed, by means of which the alloying powder is caused to adhere to the surface of the ferrous powder. No segregation of the alloying powder occurs in the iron base powder mixture when used for powder metallurgy.

BRIEF DESCRIPTION OF THE DRAWINGS

FIG. 2(*a*) is a scanning electron microphotograph showing a part of a mixture of the present invention comprising alloying powders of copper and graphite adhered to the surface of an iron powder.

FIG. 2(*b*) is a schematic illustration of this photograph.

FIGS. 3 (*a*)-(*d*) are EPMA distributions of alloying elements of the mixture of FIG. 2.

FIGS. 9-1*a* to 91*d* and 9-2*a* to 9-2*d* are graphs of the relationships between the dimensional changes and carbon contents of the practical and comparative examples.

Figure 1:
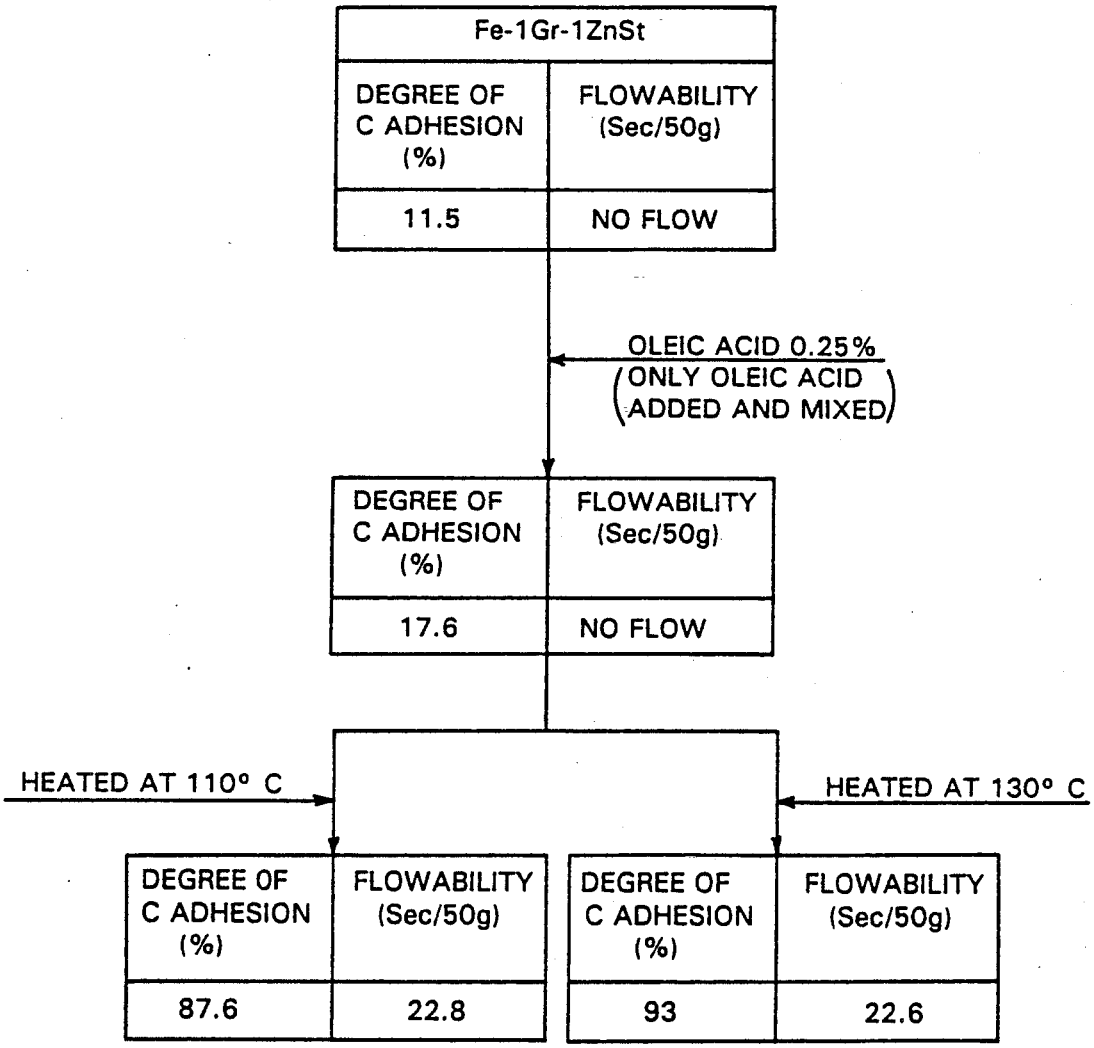
FIGS. 1-1, 1-2 and 1-3 are process diagrams showing the nature of adhesion of the alloying powder to the iron powder when various powders were produced under various conditions.
Figures 1, 2:
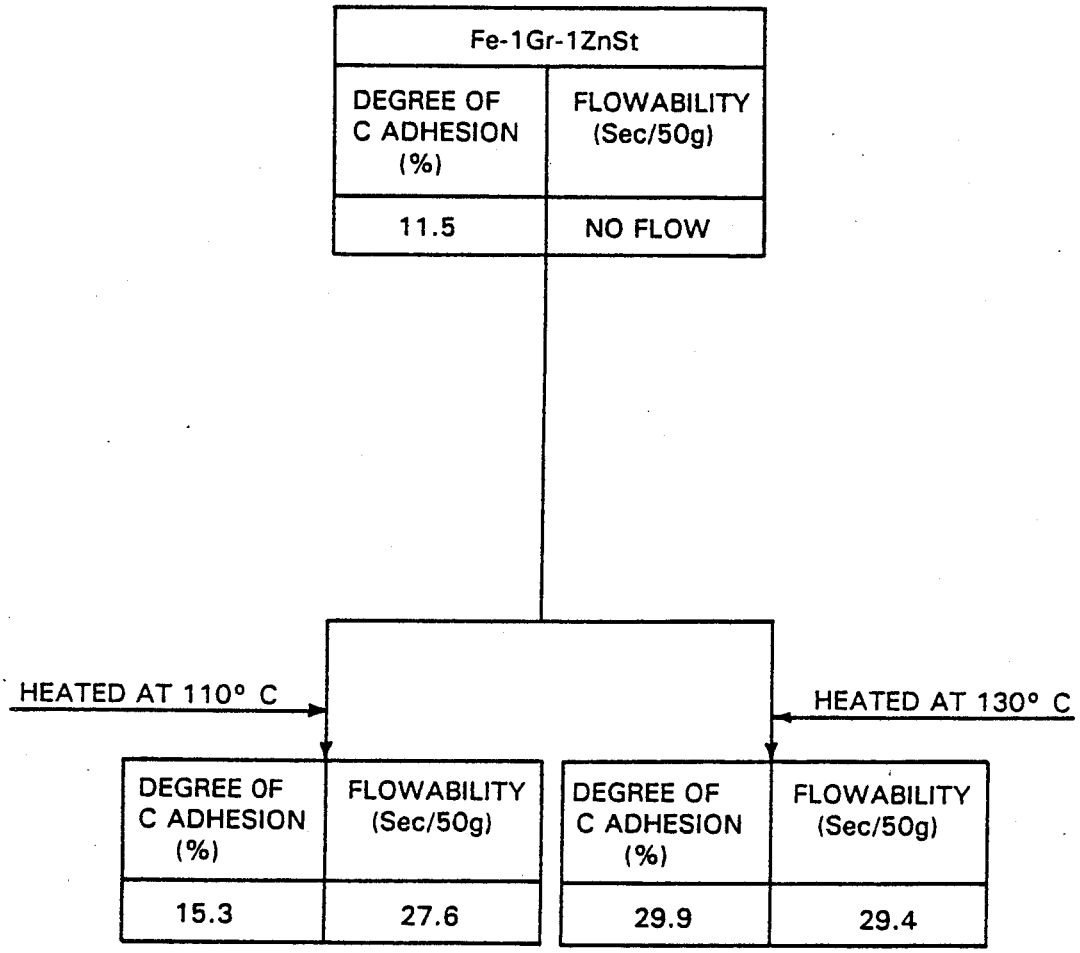
Figures 1, 2, 3:
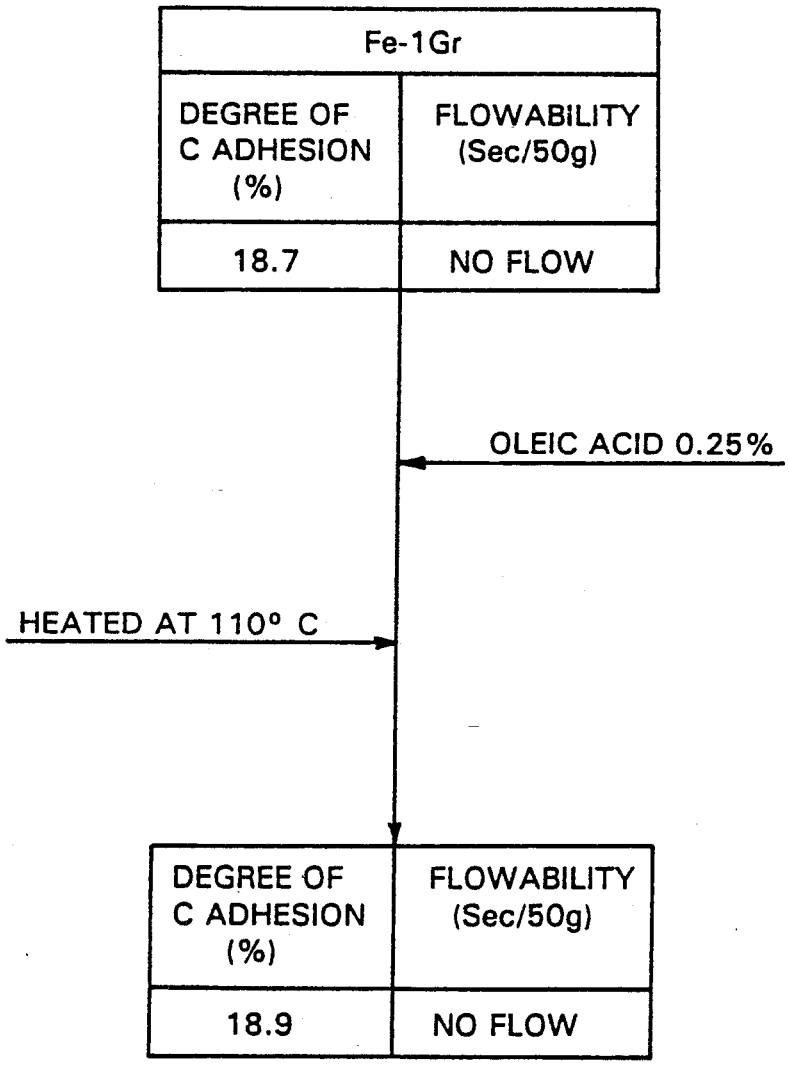
Figure 2A:
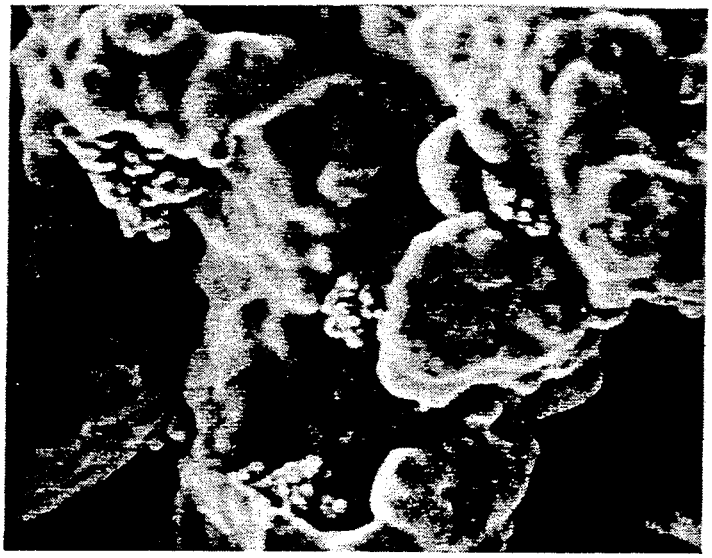
Figure 2B:
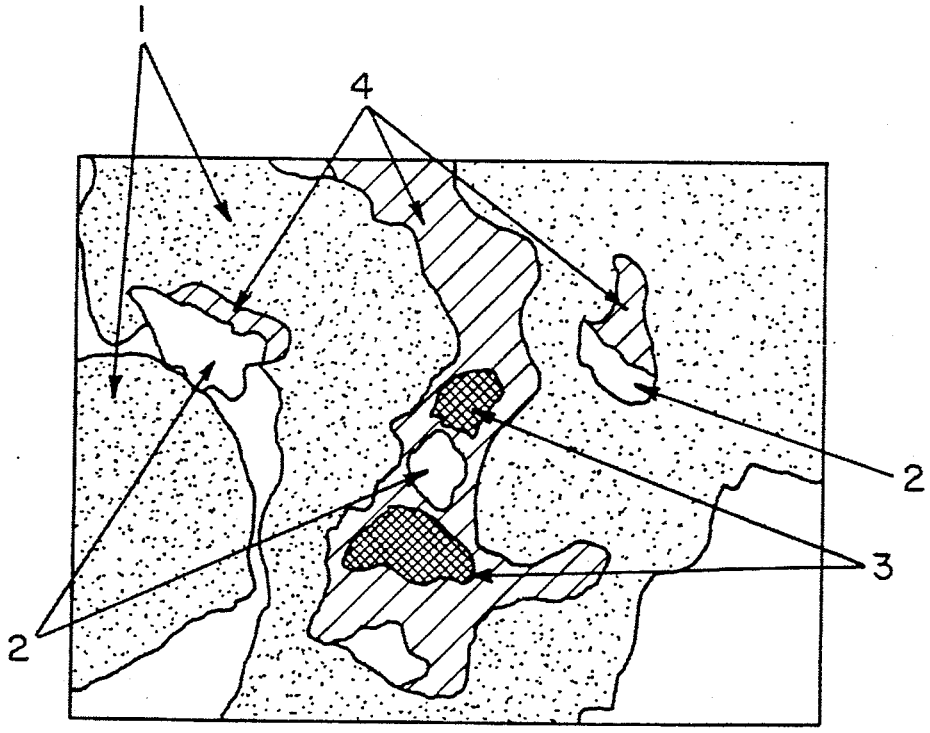
Figure 3A:
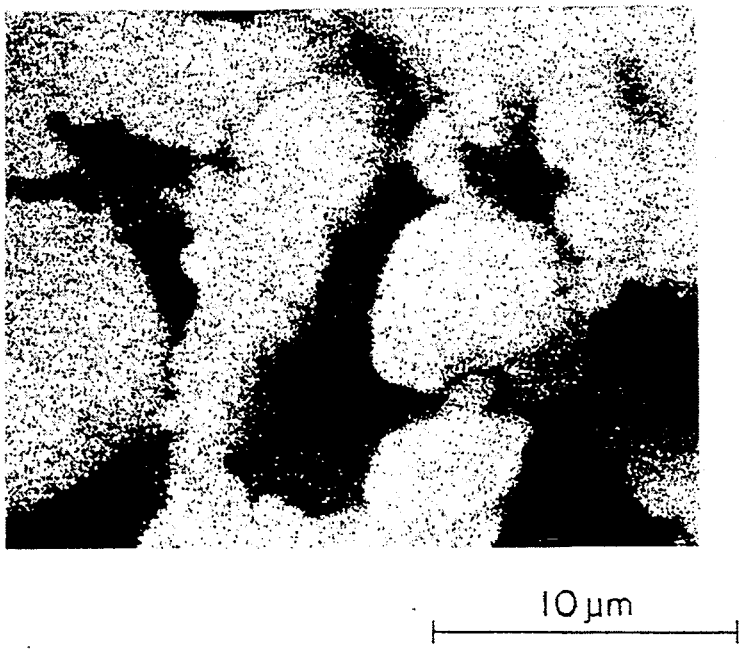
Figure 3B:
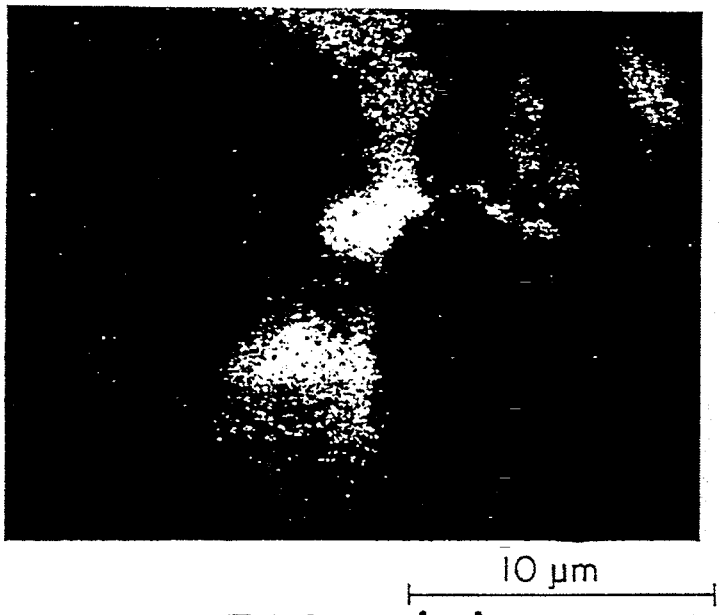
Figure 3C:
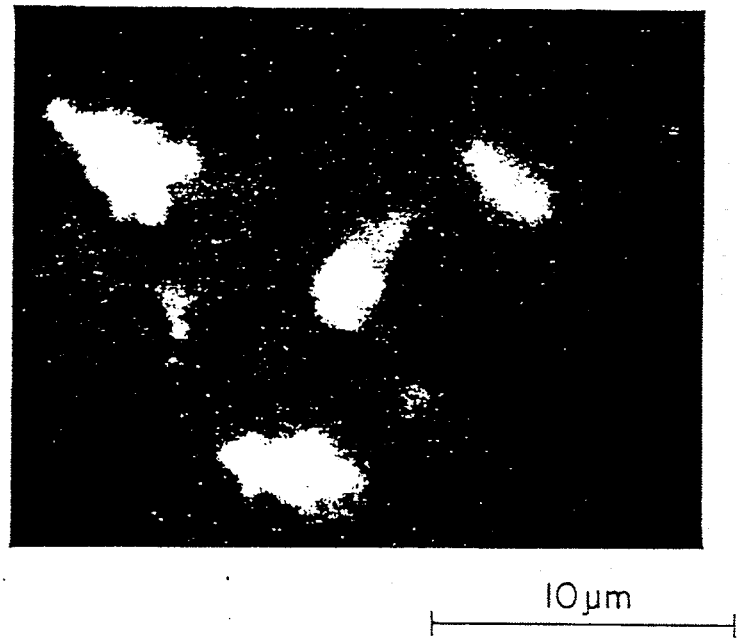
Figure 3D:
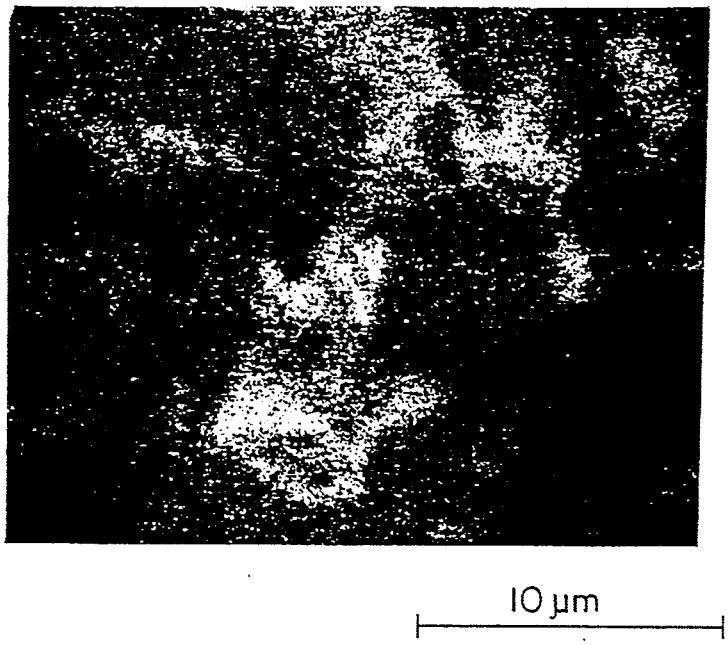

In the drawings the applied numerals have the following meanings:

1. ferrous powder
2. copper powder
3. graphite powder
4. melted-together binder
5. zinc stearate powder
6. oleic acid film FIGS. 1-1, 1-2 and 1-3 show the results of studying the adhesion of the alloying powder to the ferrous powder using graphite powder as an example. In FIG. 1-1, 1% by weight graphite powder (Gr) having a mean particle diameter of 15 μm, all of which was 200 mesh or smaller, and 1% by weight of zinc stearate (ZnSt) were added to atomized iron powder (Fe) having a mean particle diameter of 78 μm, and premixed. 0.25% by weight of commercial oleic acid was then added as the oil, and the product was mixed homogeneously. The mixture was then heated for 15 minutes in the range of 110° C. to 130° C. while mixing, and then cooled to 85° C. or less while mixing. FIG. 1-1 also shows the condition before the heating stage.

FIG. 1-2 shows a procedure wherein the heating and mixing were conducted without adding oleic acid. This is a comparative example conducted in order to examine the respective effects of oleic acid, zinc stearate and heating. FIG. 1-3 shows a further comparative example conducted by heating and mixing after adding oleic acid only but without adding zinc stearate.

The following was established in the tests represented by FIGS. 1-1, 1-2 and 1-3. Almost no improvement of the degree of C adhesion, nor any improvement of the flowability of the powder, is produced by simply adding oleic acid and zinc stearate and mixing without heating. The degree of C adhesion and the powder flowability are also completely unchanged from before the treatment when no zinc stearate is added and only oleic acid is added, and the mixture is heated. On the other hand, the degree of C adhesion is less than 30% and prevention of segregation is insufficient, although the flowability of the powder improves markedly when only zinc stearate but not oleic acid is added and heating is performed at 110° C. or 130° C., which is above the 120° C. melting point of zinc stearate.

The degree of C adhesion exceeds 80% and the flowability of the mixture is improved markedly when oleic acid and zinc stearate are added, mixed, and heated according to the present invention.

It is novel in accordance with this invention that the oil such as oleic acid, and the lubricant such as zinc stearate, must be present together and that mixing and heating must be conducted in order to increase the degree of C adhesion, prevent dust generation, and improve the flowability of the powder.

FIG. 2(*a*) is a microphotograph which shows the results of scanning electron microscopy of a mixture in which the alloying powder was adhered to the ferrous powder surface by a melted-together binder of oleic acid and zinc stearate of this invention. The mixture of FIG. 2(*a*) was made by adding 2% by weight electrolyzed copper powder having a mean particle diameter of 28 μm, 1% by weight graphite powder having a mean particle diameter of 16 μm, and 1% by weight zinc stearate to atomized iron powder having a mean particle diameter of 78 μm, and premixed. After this, 0.19% by weight oleic acid was added and mixed homogeneously, after which the mixture was sampled. This was further heated at 110° C. and mixed and later cooled, and a binder composed of oleic acid and stearic acid melted together was produced, obtaining the mixture of FIG. 2(*a*). FIG. 2(*b*) is a model of this, wherein the reference number 1 designates particles of ferrous powder. 2 designates copper powder, 5 designates graphite powder and 4 designates the melted-together binder of zinc stearate and oleic acid.

FIG. 3 represents the results of EPMA (X-ray microanalyzer) distributions of alloying elements corresponding to FIG. 2(*b*); FIGS. 3(*a*), (*b*), (*c*), and (*d*) show the conditions of incorporation of the ingredient Fe, C, Cu and Zn, respectively.

Figure 4A:
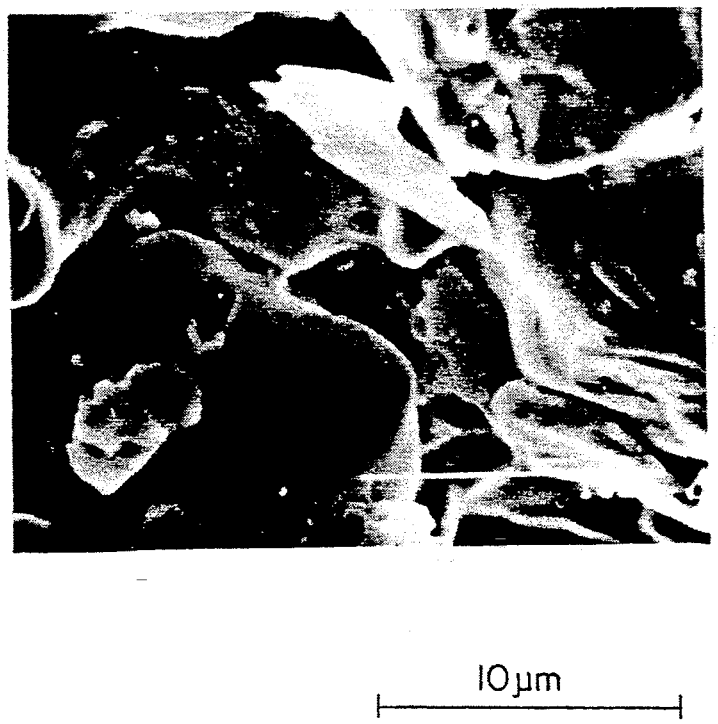
FIG. 4(*a*) is a scanning electron micrograph of a conventional mixture while FIG. 4(*b*) is a schematic illustration of this photograph.
Figure 4B:
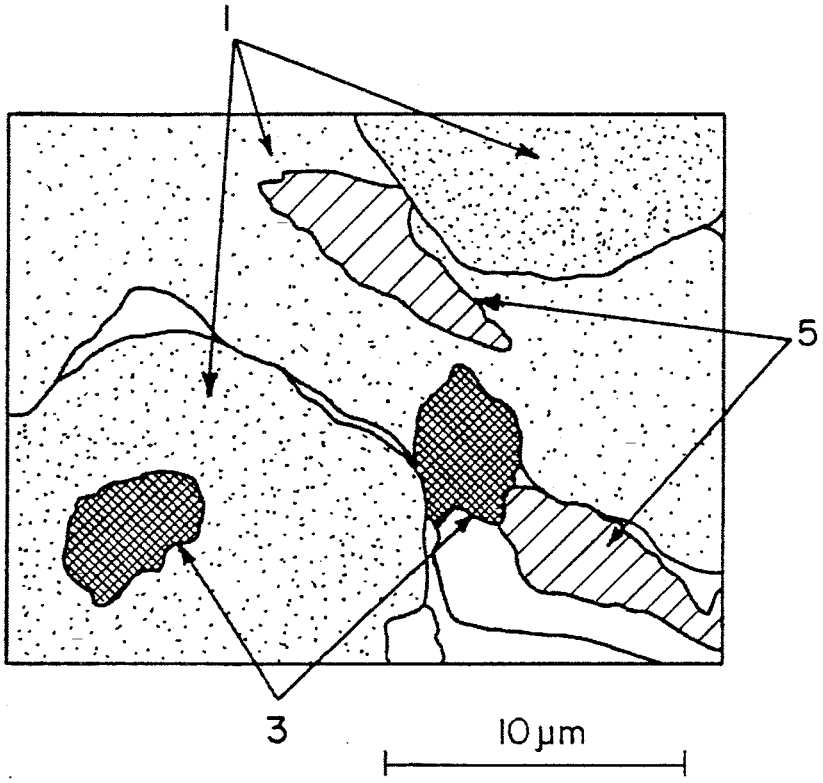

FIG. 4(*a*) is an electron microphotograph of a mixture in which, as a comparison example, the powder for alloying was caused to adhere by the caking effect of oleic acid only, without performing heating. FIG. 4(*b*) is a model of this mixture wherein the number 1 designates the ferrous powder, 3 graphite powder and 5 zinc stearate powder.

As is clear from FIG. 2(*a*) and 2(*b*), the graphite powder 3 and the copper powder 2 are present in the hollows of the particles of iron powder 1, and particles of flake-shaped graphite powder 3, with a comparatively small size, are caused to adhere by being covered with or enveloped by the melted-together binder 4 composed of oleic acid and zinc stearate. The particles of the needle shaped copper powder 2 have a comparatively large size and enter the hollows and are caused to adhere by the binder 4. The graphite powder 3 and the copper powder 2, firmly adhered in this way by the melted-together binder 4 of oleic acid and zinc stearate, do not produce segregation or dust generation in subsequent handling up to the press compaction procedure.

On the other hand, in the comparative example shown in FIG. 4(*b*) copper powder having a high specific gravity does not adhere to the iron powder surface; the graphite powder 3 and the zinc stearate powder 5 are associated with the iron powder surface in an unstable way because of point contact due only to the caking effect of the oleic acid. The graphite powder which adheres in an unstable manner is very susceptible to segregation and dust generation brought about by vibration during subsequent handling steps leading up to the press compaction procedure.

Figure 5:
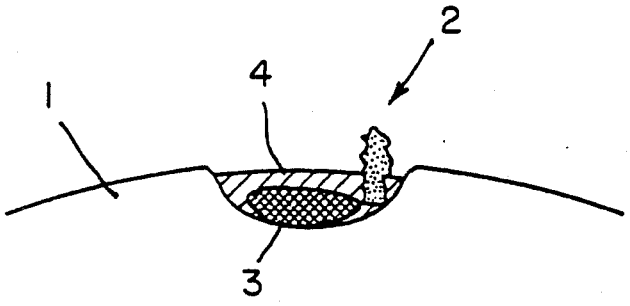
FIGS. 5 and 6 are schematic illustrations of the adhesion of the alloying powder.

FIG. 5 shows the adhesion machanism of the alloying powders 2 and 3 to the surface of the ferrous powder 1 in this invention, in model form. In this invention, as shown in FIG. 5, the graphite powder 3 and the copper powder 2, covered by the melted-together binder 4, arc strongly bonded to the surface of the ferrous powder 1.

Figure 6:
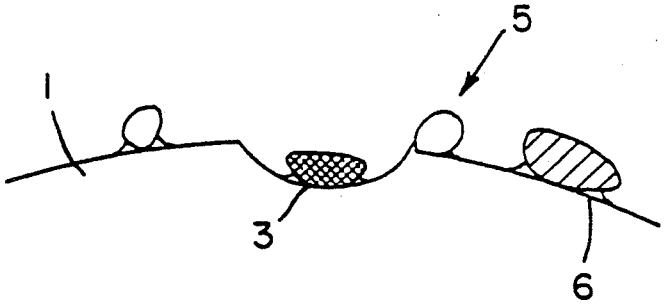

FIG. 6 shows the lack of the inventive adhesion mechanism of a comparative example, in model form. The graphite powder 3 and the zinc stearate powder 5 are only contacted at the surface of the ferric powder 1 through a thin film of oleic acid 6.

Figure 7:
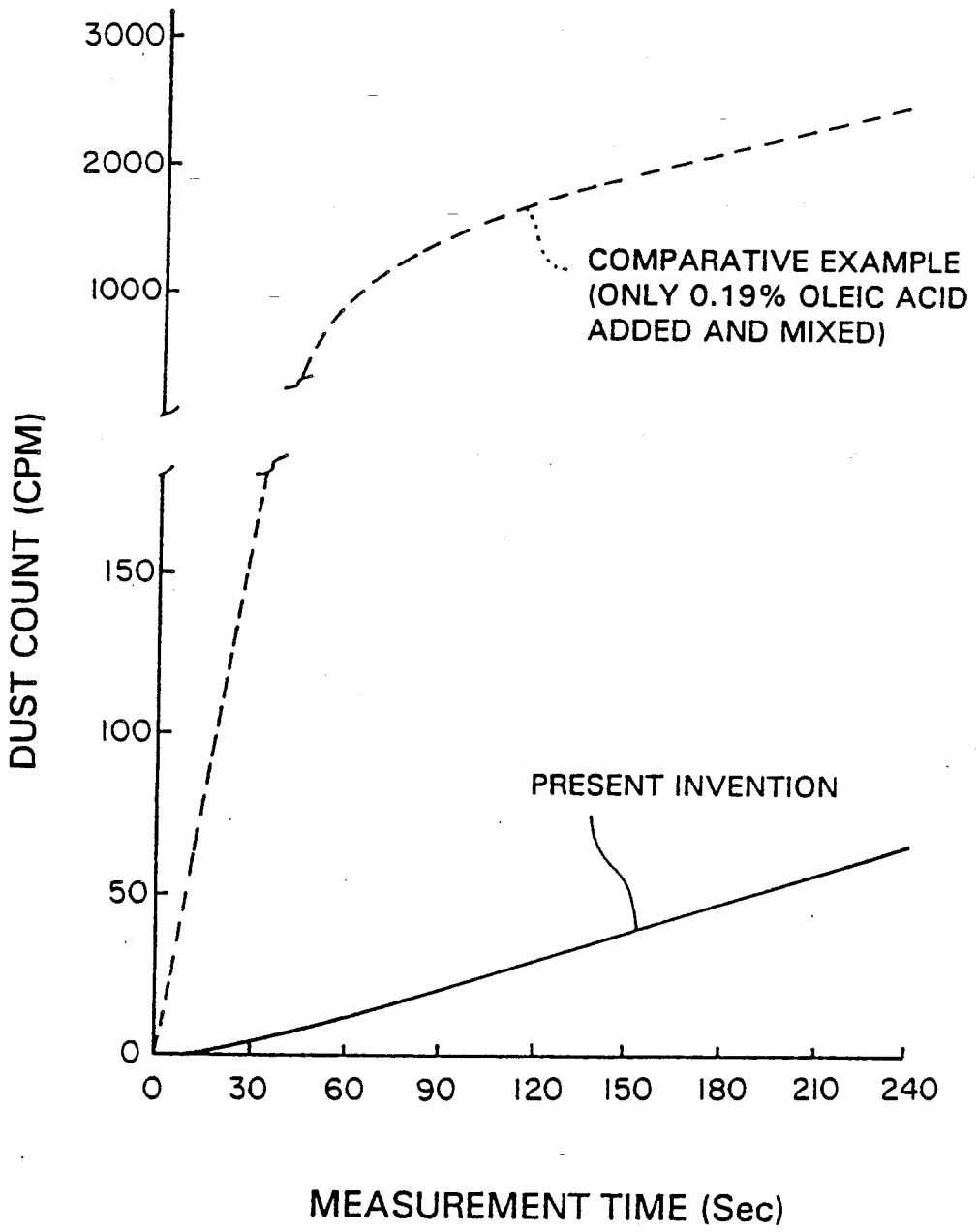
FIG. 7 is a graph of dust counts.

FIG. 7 shows the values obtained when 160 g of a mixture produced in this experiment were dropped from a height of 50 cm in a sealed vesel and the amount of dust thereby generated was measured by a digital dust measurement apparatus (scattered light type, Shibata Kogaku Kiki Kogyo Co., Model P-3). Dust generation is surprisingly prevented by the novel process which includes heating in accordance with this invention. It was also established that there is a close correlation between dust generation and degree of C adhesion.

Industrially marketed oleic acid is obtained by distillation after decomposing beef tallow, olive oil, rice-bran oil, or vegetable and animal fatty acids and removing the solid fatty acids. It is a light yellow liquid having unsaturated bonds in the center. It approaches transparancy as the degree of refinement rises. Its chemical formula is $CH_3(CH_2)_nCH{=}CH(CH_2)_n$ COOH. However various grades of commercial oleic acid contain varying amounts of other acids such as linoleic, myristic, palmitic and stearic acids and other saturated and unsaturated acids, all of which operate effectively in melted-together combination with lubricants such as zinc stearate, and are intended to be covered by the general term "oleic acid " in accordance with this invention.

Heating is a requisite condition for raising the degree of C adhesion. Oleic acid is believed to increase the degree of C adhesion by increasing the caking power when double bonds are obtained by heating.

It has been observed that the melting point of an oleic acid-zinc stearate mix decreases to 104° C. when mixing 1% by weight zinc stearate having a melting point of 120° C. with 0.25% by weight oleic acid. The degree of C adhesion was 29.9% when only zinc stearate but not oleic acid was added and the mix was heated at 130° C., which exceeds the melting point of zinc stearate. The degree of C adhesion was more than 80% when both oleic acid and zinc stearate were added and the mix was heated to 110° C.

It is found based on these facts that although adhesion by use of the caking powder of oleic acid alone was unstable, a very good ferrous and graphite powder may be made if it is coated with a binder consisting of a melted-together mixture that enjoys the synergistic effects of oleic acid and lubricant and heating, and that adhesion of the binder to the particles is further strengthened by cooling.

The coating of this melted together mixture of oleic acid and lubricant not only further strengthens the adhesion between the ferrous powder and the alloying powder but also contributes affirmatively to the flowability of the mixture.

The differences between this invention and the previously published Japanese Kokoku Patent No. Sho 58-28321, Japanese Kokai Patent No. Sho 56-136901, Engstrom U.S. Pat. No. 4,676,831 and Japanese Patent Publication No. Sho 60-50218 are not limited only to the kind and quantity of the binder; the mechanisms of adhesion of the alloying powders to the ferrous powder also differ. That is, in this invention, as shown in FIG. 5, the alloying powders are embedded in the melted-together binder and reliably caused to adhere to the ferrous powder, whereas in the known methods the alloying powders adhere to the surface of the ferrous powder by point contact, due only to the caking force of the oleic acid or the reaction of tall oil with the iron. This caking force is weak and unstable, and there is little effectiveness in preventing segregation and dust generation of the mixture.

The novel effects of this invention can only be accomplished by using a melted-together binder of oil and metal soap or wax powder as the binder. Moreover, the degree of segregation, flowability, and green compact density of the mixture obtained are closely related to the weight ratio of the oil and the metal soap or wax powder constituting the melted-together binder and the total quantity of the melted-together binder.

The weight ratio of the oil and the metal soap or wax powder constituting the melted together binder strongly affects the segreration of the alloying powder and the flowability of the mixture. Table 1 shows the results of investigating the state of adhesion of the graphite powder to the ferrous powder due to the melted-together binder, the flowability, and the compact density, with the weight ratio of the oleic acid and the zinc stearate varied, on the basis of the following composition: 2% by weight electrolytic copper powder, with a mean diameter of 28 μm and more than 93% 200 mesh or smaller, and 1% by weight graphite powder, with a mean diameter of 6 μm and all 200 mesh or smaller. Moreover, for comparison, an example in which only the zinc stearate was melted, without adding the oleic acid (Comparative Example 1) and examples in which only oleic acid was added as the binder, and heating was not performed (Comparative Examples 6 and 7).

TABLE 1

| | Oleic acid [O] (%) | Zinc stearate [St] (%) | [O]/[St] | Binder [O] + [St] (%) | Degree of C adhesion (%) | Flow-ability (sec/50 g) | Green compact density (g/cm$^3$) |
|---|---|---|---|---|---|---|---|
| Comp. Ex. 1 | — | 1.0 | — | — | 31 | 23.4 | 6.86 |
| Comp. Ex. 2 | 0.05 | 0.5 | 0.1 | 0.55 | 53 | 23.1 | 6.85 |
| Prac. Ex. 1 | 0.10 | 0.5 | 0.2 | 0.60 | 81 | 23.7 | 6.85 |
| Prac. Ex. 2 | 0.20 | 0.5 | 0.4 | 0.70 | 83 | 24.2 | 6.85 |
| Comp. Ex. 3 | 0.25 | 0.5 | 0.5 | 0.75 | 85 | 27.2 | 6.84 |
| Comp. Ex. 4 | 0.05 | 1.0 | 0.05 | 1.05 | 57 | 23.2 | 6.85 |
| Prac. Ex. 3 | 0.10 | 1.0 | 0.1 | 1.10 | 75 | 23.2 | 6.85 |
| Prac. Ex. 4 | 0.20 | 1.0 | 0.2 | 1.20 | 92 | 23.1 | 6.85 |
| Prac. Ex. 5 | 0.30 | 1.0 | 0.3 | 1.30 | 97 | 24.2 | 6.84 |
| Prac. Ex. 6 | 0.30 | 1.2 | 0.25 | 1.50 | 96 | 23.9 | 6.84 |
| Comp. Ex. 5 | 0.30 | 1.3 | 0.23 | 1.60 | 97 | 23.9 | 6.80 |
| Comp. Ex. 6 | 0.15 | 1.0 | 0.15 | 1.15 | 25 | 29.0 | 6.84 |
| Comp. Ex. 7 | 0.30 | 1.0 | 0.30 | 1.30 | 29 | No flow | 6.82 |

Many observations may be based on Table 1. With the melted binder composed only of zinc stearate, without adding oleic acid, the degree of C adhesion was 31%, and the segregation-preventing effect was insufficient. Moreover, the examples in which the oleic acid was not heated and 0.15% and 0.30% by weight were added show degrees of C adhesion of less than 60%; the segregation-preventing effect was poor in these cases. When 0.3% by weight were added, the degree of C adhesion was improved, but the mixture did not flow well. Since the decrease in compact density was also large, this mixture was unsuitable as a mixture for powder metallurgy. In contrast to this, with the present invention, a synergistic effect of the oleic acid and the zinc stearate on the degree of C adhesion was observed. When the ratio of the oleic acid and zinc stearate in the melted-together binder was more than 0.1 and the quantity of melted-together binder is more than 0.60% by weight, the degree of C adhesion becomes greater than 65%, and the segregation-preventing effect is substantial.

When the ratio of the oleic acid and the lubricant exceeds 0.4, the flowability is harmed, which is undesirable. Moreover, when the quantity of melted-together together binder exceeds 1.5% by weight, the compact density is reduced, which is undesirable.

Carbon is a relatively inexpensive substance which increases the strength of the sintered body and is a typical alloy element, but usually when it exceeds 3.5% by weight the excess C is precipitated out, which is undesirable.

The present invention prevents segregation and dust generation by fixing the alloy powder to the ferrous powder surface; the degrees of C adhesion at which the alloying powder does not undergo segregation during handling up to the press compaction step are 65% and greater; below 65%, the segregation preventing effect is poor.

Moreover, particularly in the handling of the powder mixture, when the quantity of graphite powder is large, there is normally a problem of loss of graphite powder due to dust generation, causing health problems for the workers. The amount of dust generation which can prevent these problems, when 160 g of a mixture produced in this experiment are dropped from a height of 50 cm in a sealed vessel and the amount of dust generated accordingly is measured by a digital dust measurement apparatus, is 300 count or less; when it exceeds 300 count, the effect of preventing dust generation is poor.

The mixer used in practicing this invention may be a double cone type mixer, a V-type mixer, or a grouter mixer, etc., any of which may be used to produce known powder mixtures that can be heated and mixed. Steam is satisfactory as the heat source since it provides low temperature heating.

The mixing sequence is usually to add the alloying powder to the ferrous powder, mix them, and then add and mix the zinc stearate or wax powder. The oil can be mixed by spraying at any mixing stage. A homogeneous mixture is obtained in this way. It is important that the heating temperature be kept no higher than 85° C. in the process before the homogeneous mixture is obtained. The entire mixture becomes sticky and solidifies unevenly when heated above 85° C. before homogeneous mixing, producing segregation in the final mixture.

In the method of producing the powder mixture of the present invention, both the heating temperature and cooling temperature have great significance. The heating temperature is in the range of 90° C.–150° C. In the case of oleic acid and zinc stearate adhesion of the alloying powder to the ferrous powder surface begins from around 104° C., which is the eutectic point of oleic acid and zinc stearate. The temperature at which this effect is found is 90° C. On the other hand, when the heating temperature exceeds 150° C., zinc stearate vapor is produced; thus, the practical upper limit is 150° C., when zinc stearate is used.

However, a heating temperature of 110°–130° C. is preferred based on the balance between the degree of adhesion of the alloy powder, the properties of the mixture obtained, and production costs. Furthermore, the degree of adhesion of C does not differ according to the mixing time; the time required for the melted-together binder to be produced and made homogeneous is from 10-odd minutes to several tens of minutes.

As stated, the mixture is subsequently cooled to 85° C. or less. The powder mixture remains sticky when heated above 90° C.; therefore, the powder congeals slightly when cooled in a static condition. Cooling in the course of mixing is consequently necessary to prevent congealing. The upper limit of the cooling temperature is 85° C., since the mixture does not congeal.

Vegetable oils, mineral oils, or fatty acids, etc., all have the effect of preventing segregation of the powder for alloying; rice-bran oil, spindle oil, or oleic acid, etc., can be used. The amount of oil added should be within a range that does not cause deterioration of the properties of the mixture and a range in which it can be removed easily during dewaxing in a later process.

The oil should be added by spraying for the sake of homogeneous dispersion of the binder on the powder particles.

Common lubricants for powder metallurgy, such as metal soaps, including zinc stearate, etc., or wax powder, etc., can be used as the lubricant. The amount added should usually be approximately the same as that of the mixture for powder metallurgy, but considering properties such as the degree of C adhesion and the compact density of the mixture, 0.60–15% by weight should be added, as the melted-together binder of the lubricant. Addition can be regulated appropriately after producing the mixture of the present invention, if necessary.

Graphite powder, ferrophosphorus powder, ferrosilicon powder, Ni powder, or Cu powder can be used as the alloying powder Unlike the alloying powders, powders which are generally used for adding alloy elements in the mixed powder method, such as talc, forsterite powder, etc., can be used for improving machinability.

Among these alloy powders, those which greatly affect the properties of the sintered body because their specific gravity differ greatly from ferrous powder, since they facilitate segregation and cause segregation. They include graphite powder, ferrophosphorus powder, forsterite powder, etc.

Graphite powder is an indispensible powder for many alloys; it is very widely used in general practice in the production of machine parts by powder metallurgy methods. Moreover, it is added as graphite powder by the mixed powder method because it decreases the compressibility of the powder and because the solid solution hardening is large when it is prealloyed as C with ferrous powder. However, graphite powder readily causes segregation, increases fluctuations in the dimensional changes of sintered machine parts, and decreases the product yield rate.

On the other hand, ferrophosphorus powder is generally used in powder metallurgy methods in combination with graphite powder in order to achieve density by generating a liquid phase Generation of a homogeneous liquid phase is desirable from the standpoint of the product stability of sintered machine parts. Segregation of ferrophosphorus powder must be avoided from this viewpoint.

Talc and forsterite are powders that improve the machinability of sintered bodies, but these powders tend to produce segregation because their specific gravities are greatly different from that of ferrous powder. Segregation of talc or forsterite must also be avoided to maintain stable machinability.

The results of studying these three types of powders according to the present invention proved that segregation of all of them can be prevented, and that the effects of the present invention are great.

Of course, the aforementioned effects are found even when the present invention is applied to many other powders besides these powders that do not segregate readily, e.g., Cu powder, Ni powder, ferrosilicon powder, bronze powder, etc.

EXAMPLES

The present invention will be explained in detail below using practical examples.

PRACTICAL EXAMPLE 1

As a further Example, one percent by weight of natural graphite powder having a mean particle diameter of 16 μm, all of which was less than 200 mesh, and 1% by weight zinc stearate were added to and mixed with atomized iron powder for powder metallurgy having a mean particle diameter of 78 μm. After this, 0.30% by weight each of oils made of rice-bran oil, spindle oil, and oleic acid were mixed homogeneously. After mixing and heating with steam at 110° C., the mix was cooled to lower than 85° C. while mixing, and powder mixtures were produced in which the graphite powder was fixed to the iron powder surface by the melted-together binders of the various oils and the zinc stearate (Practical Examples 7, 8, and 9).

The degree of C adhesion and the flowability of the powder were both studied for these mixtures. An ordinary mixed powder method with no binder added and no heating conducted was also carried out for the sake of comparison (Comparative Example 8). The results are shown in Table 2.

The results showed that the degree of C adhesion, which illustrates the effect of binding the ferrous powder and the powder for alloying, was markedly improved by all the melted-together binders composed of oils and zinc stearate, in comparison to ordinary mixed powder. The effects of preventing segregation of the ferrous powder were also great. On the other hand, as for flowability, only the powder with the oleic acid oil flowed naturally; the powders with the other oils are not flowable. The results showed that the melted-together binder of oleic acid and zinc stearate is highly preferable in regard to the degree of C adhesion and the flowability of the mixture.

| | Oil | Degree of C adhesion (%) | Flowability (sec/50 g) |
|---|---|---|---|
| Practical Example 7 | Oleic acid | 87.6 | 22.8 |
| Practical Example 8 | Rice-bran oil | 89.2 | No flow |
| Practical Example 9 | Spindle oil | 94.1 | No flow |
| Comparison Example 8 | Ordinary mixed powder | 11.5 | No flow |

PRACTICAL EXAMPLE 2

Figure 8A:
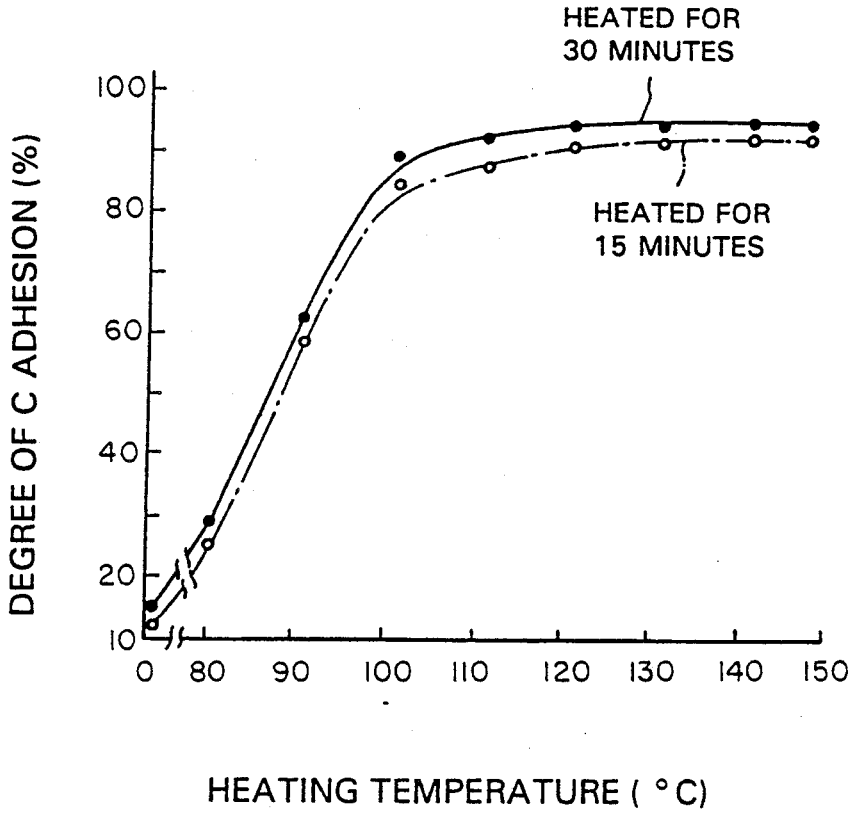
FIGS. 8*a* and 8*b* is a graph of the relationships between the heating temperature and the degree of carbon adhesion and flowability.
Figure 8B:
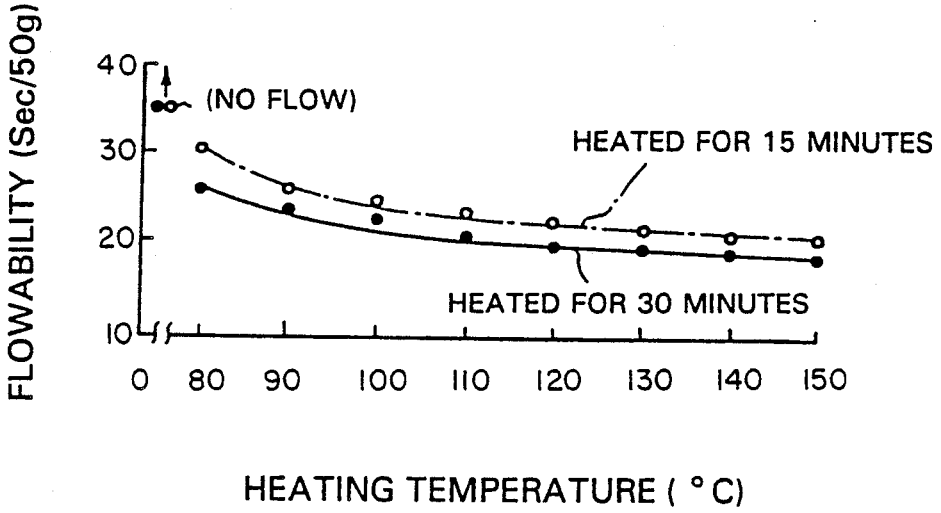

One percent by weight of natural graphite having a mean particle diameter of 16 μm was added to and mixed with atomized iron powder for powder metallurgy having a mean particle diameter of 78 μm. After this, 1% by weight of zinc stearate was added and mixed, and 0.25% by weight of oleic acid was sprayed. After the mixture was thoroughly homogenized, it was heated and mixed for 15 minutes and 30 minutes at the following temperatures 80° C., 100° C., 110° C., 120° C., 130° C., 140° C., and 150° C. After this, the mixtures were cooled to 85° C. while mixing, and powder mixtures were produced in which the graphite powder was fixed to the iron powder surface by the melted-together binder of oleic acid and zinc stearate. The mixtures were analyzed for the degree of C adhesion of the iron powder and the powder for alloying and the flowability of the powder. The results are shown in FIG. 8.

The results showed that the effect of binding the ferrous powder and the alloying powder is observed at temperatures of 90° C. or greater. Preferable heating temperatures, which satisfy sufficiently both the requirements for flowability and for production cost, are 110°-130° C. The heating time may be a time in which the ferrous powder and the powder for alloying can be mixed sufficiently homogeneously during the period of heating and mixing. Ordinarily, the heating time is from 10-odd minutes to several tens of minutes; there is no need to make it unnecessarily long.

PRACTICAL EXAMPLE 3

Since commercial industrial oleic acid is produced from beef tallow, olive oil, rice-bran oil, or animal or vegetable fatty acids as raw materials, it necessarily contains impurities.

Therefore, the effects of the purity of the oleic acid on the degree of C adhesion and flowability were studied.

One percent by weight of natural graphite powder having a mean particle diameter of 16 μm was added to and mixed with atomized iron powder for powder metallurgy having a mean particle diameter of 78 μm. After adding and mixing 1% by weight of zinc stearate, 0.25% by weight of each of three types of oleic acid of different purity was sprayed on and mixed homogeneously. After heating to 110° C. while mixing, powder mixtures in which the graphite powder was fixed to the iron powder surface by the melted-together binders of oleic acids of various purities and zinc stearate were produced by cooling to 85° C. while mixing. The degrees of C adhesion between the ferrous powder and the powder for alloying and the flowabilities of the powders were both analyzed in the mixtures (see Table 3).

The results showed that the binding effects between the ferrous powder and the graphite powder were satisfactory with oleic acids of any purity. The flowability was also satisfactory. Therefore, inexpensive, low-purity oleic acid is suitable industrially from the standpoint of cost.

PRACTICAL EXAMPLE 4

2% by weight of electrolytic copper having a mean particle diameter of 28 μm, 93% of which was 200 mesh or less, and 1% by weight of natural graphite powder having a mean particle diameter of 16 μm, oil of which was 200 mesh or less, were mixed with atomized iron powder for powder metallurgy having a mean particle diameter of 78 μm. Powder mixtures having degrees of C adhesion of 43% (Comparative Example 9), 68% (Practical Example 11), and 87% (Practical Example 10) were produced by using melted-together binders with varying weight ratios of oleic acid and zinc stearate. Moreover, for comparison, an ordinary mixed powder of the same composition (degree of C adhesion 22%) was prepared (Comparative Example 10). The powder properties of the mixtures and the green compacts made by using a molding pressure of 5 t/cm$^2$ were investigated. The results are shown in Table 4.

TABLE 3

| Oleic acid purity | Saturated fatty acids: Myristic acid | Saturated fatty acids: Palmitic acid | Saturated fatty acids: Stearic acid | Unsaturated fatty acids: Oleic acid | Unsaturated fatty acids: Limetic acid | Degree of C adhesion | Flowability (sec/50 g) |
|---|---|---|---|---|---|---|---|
| Low | 3% | 6% | 1% | 75% | 15% | 91.2 | 23.1 |
| Medium | 3% | 6% | 1% | 81% | 9% | 84.7 | 23.2 |
| High | 3% | 6% | 1% | 37% | 3% | 92.3 | 24.5 |

TABLE 4

| | Powder properties: Degree of C adhesion (%) | Powder properties: Apparent density (g/cm$^3$) | Powder properties: Flowability (sec/50 g) | Green compact properties: Compressed density (g/cm$^3$) | Green compact properties: Ejection force (kg/cm$^2$) | Green compact properties: Rattler value (%) |
|---|---|---|---|---|---|---|
| Prac. Ex. 10 | 87 | 3.35 | 23.1 | 6.85 | 152 | 0.36 |
| Prac. Ex. 11 | 68 | 3.34 | 23.5 | 6.85 | 153 | 0.33 |
| Comp. Ex. 9 | 43 | 3.32 | 23.5 | 6.85 | 154 | 0.36 |
| Comp. Ex. 10 | 22 | 3.19 | 32.0 | 6.34 | 153 | 0.37 |
| Ordinary | | | | | | |

TABLE 4-continued

| | Powder properties | | | Green compact properties | | |
|---|---|---|---|---|---|---|
| | Degree of C adhesion (%) | Apparent density (g/cm³) | Flow-ability (sec/50 g) | Compressed density (g/cm³) | Ejection force (kg/cm²) | Rattler value (%) |
| mixing method | | | | | | |

Figure 10:
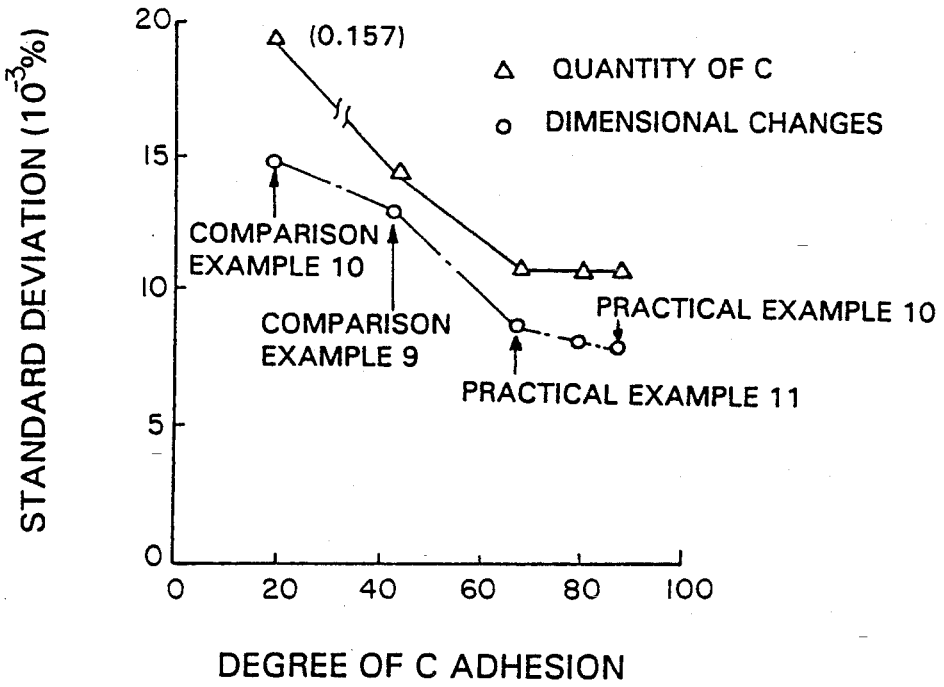
FIG. 10 is a graph of the relationship between the degree of carbon adhesion and the standard deviations.

Moreover, in order to investigate the binding of the ferrous powder and alloying powder in regard to segregation, the mixture was dropped from a two-stage hopper from a height of 80 cm and sampled at uniform intervals; test pieces 10 mm thick, 10 mm wide and 55 mm long were produced by using a compacting pressure of 5 t/cm². After sintering these pieces at 1130° C. for 20 minutes in endothermic gas, their C analyses and dimensional changes were measured. The measurement results and the fluctuation conditions are shown in FIG. 10.

Figure 11:
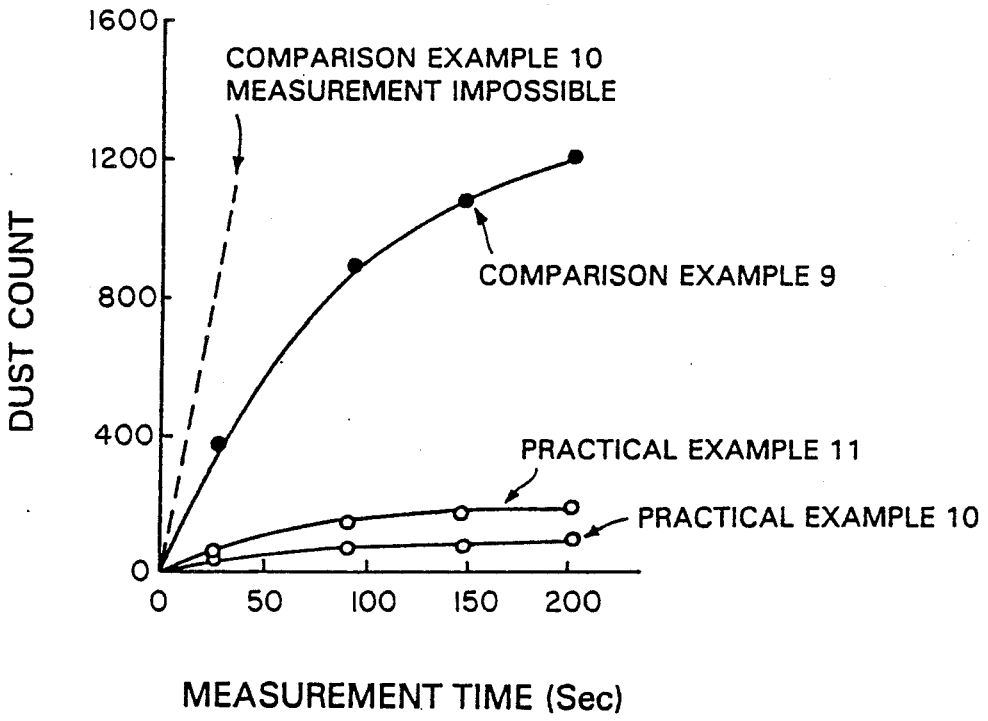
FIG. 11 is a graph of the dust counts.

Moreover, in order to measure the dust generation conditions quantitatively, 160 g of sample were dropped from a height of 50 cm in a tightly sealed vessel, and a measurement was taken with a digital dust measurement apparatus (see FIG. 11).

Figures 1A, 9:
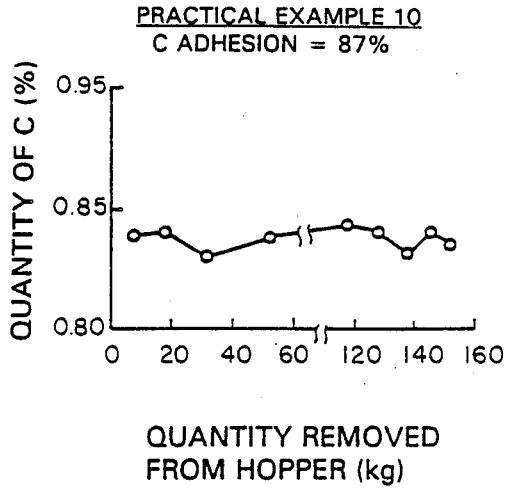
Figures 1B, 9:
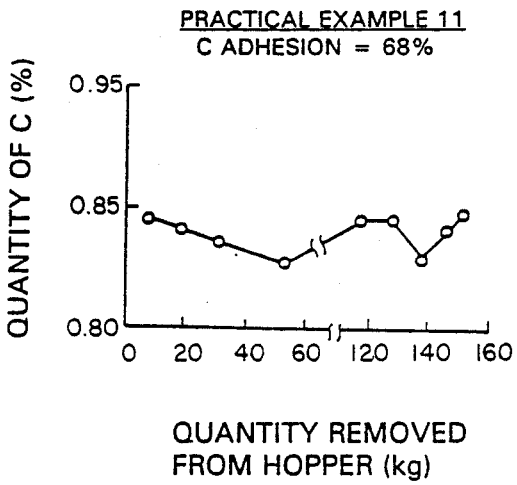
Figures 1C, 9:
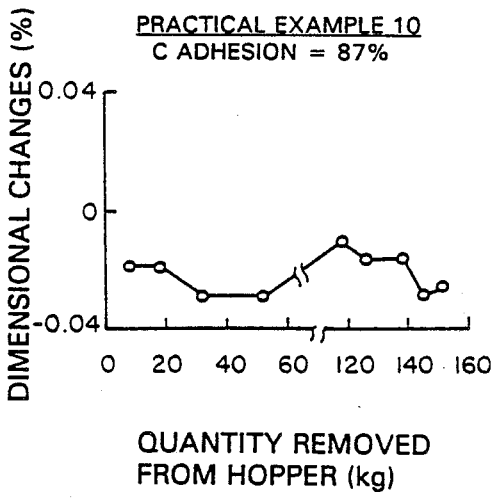
Figures 1D, 9:
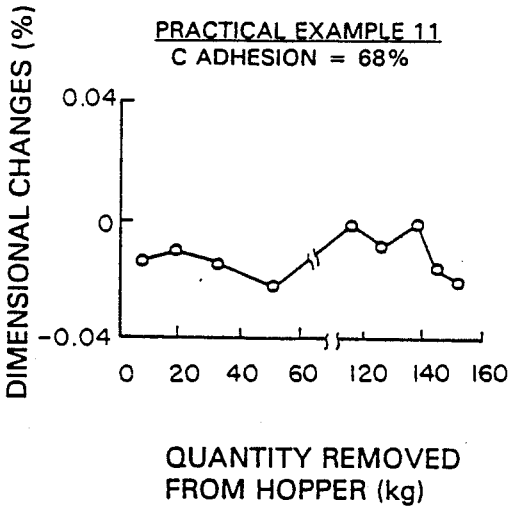
Figures 2A, 9:
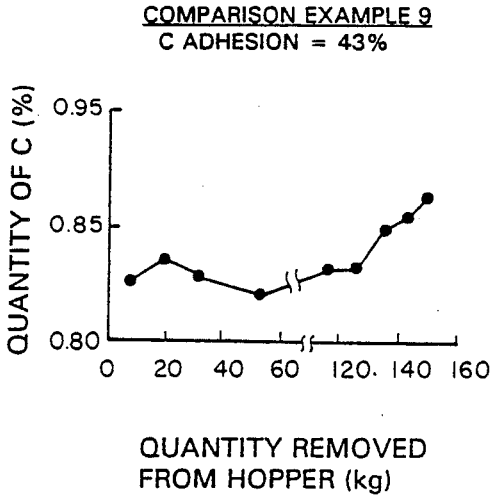
Figures 2B, 9:
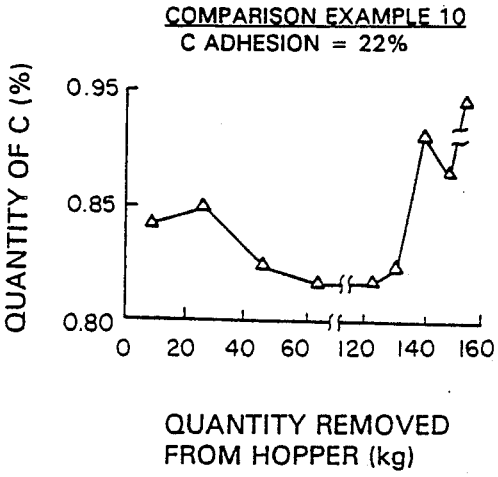
Figures 2C, 9:
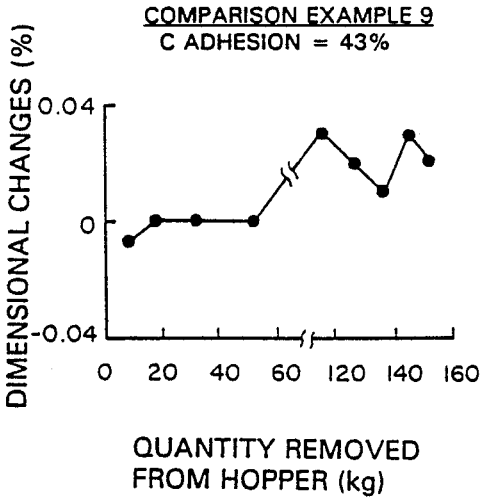
Figures 2D, 9:
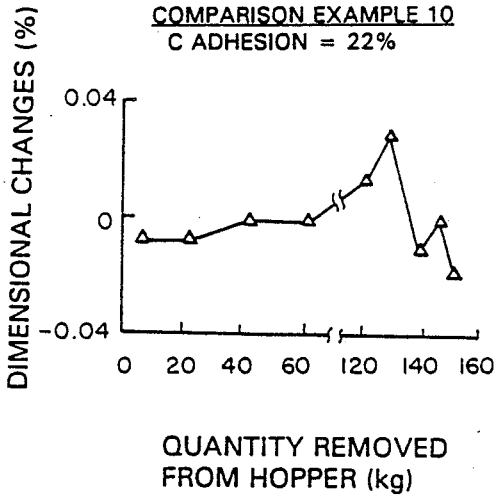

In FIG. 9, Comparative Example 10 (ordinary mixed powder, degree of C adhesion 22%) shows increased concentration of graphite powder in the period after it was dropped from the two-stage hopper; as the quantity of C in the sintered bodies becomes greater, the fluctuation of the dimensional changes also becomes greater. In Comparative Example 9 (degree of C adhesion 43%), the fluctuation becomes smaller, but an increase in graphite powder at the time of the final dropping is still seen, and the quantity of C also tends to increase.

In Practical Example 10 (degree of C adhesion 87%) and 11 (degree of C adhesion 88), this tendency disappears completely, and the dimensional changes are also extremely stable.

As shown in FIG. 10, the standard deviations of Practical Examples 10 and 11, compared to Comparative Examples 9 and 10, show extremely low values; the prevention of the segregation of the graphite powder is proven to be related to the increase in dimensional accuracy of the part.

In the dust generation test of FIG. 11, also, Practical Examples 10 and 11 showed almost no dust generation, but Comparative Examples 9 and 10 exceeds 1000 count after 210 seconds passed; it was found that the method of this invention is also extremely effective in improving the work environment.

Moreover, as can be seen in Table 4, in Practical Examples 10 and 11, compared to Comparative Example 10, the apparent density becomes high, 0.16 g/cm² or higher, and the flowability is increased dramatically. Moreover, the green compact properties are not harmed, in comparison to the conventional ordinary mixed powder.

PRACTICAL EXAMPLE 5

Powder mixtures were made by mixing 2% by weight of electrolytic copper having a mean particle diameter of 28 μm, 93% of which was 200 mesh or less, 1% by weight of natural graphite powder having a mean particle diameter of 16 μm, all of which was 200 mesh or less, and 1% by weight zinc stearate with atomized iron powder for powder metallurgy having a mean particle diameter of 78–86 μm (Comparative Examples 11, 12 and 13); 0.19% by weight oleic acid was also added to the same raw materials and this mixture was heated at 110° C. and mixed and then cooled, to make powder mixtures of the present invention (Practical Examples 12, 13 and 14). The flowabilities, degrees of C adhesion, and apparent densities of these mixtures are shown in Table 5.

TABLE 5

| | | | Apparent density (g/cm³) | Flow-ability (sec/50 g) | Degree of C adhesion (%) |
|---|---|---|---|---|---|
| Base | Fe only | — | 2.97 | 25.6 | — |
| Comp. Ex. 11 | Fe—2Cu-Gr-1ZnSt simple mixture | — | 3.27 | 32.7 | 19.1 |
| Prac. Ex. 12 | Fe—2Cu-Gr-1ZnSt + 0.19 oleic acid heated 110° C. | Segregation | 3.36 | 23.5 | 93.7 |
| Comp. Ex. 12 | Fe—2Cu-Gr-1ZnSt simple mixture | — | 3.28 | 33.5 | 18.7 |
| Prac. Ex. 13 | Fe—2Cu-Gr-1ZnSt + 0.19 oleic acid heated 110° C. | Segregation | 3.29 | 24.1 | 94.5 |
| Comp. Ex. 13 | Fe—2Cu-Gr-1ZnSt simple mixture | — | 3.13 | 36.1 | 18.5 |
| Prac. Ex. 14 | Fe—2Cu-Gr-1ZnSt + 0.19 oleic acid heated 110° C. | Segregation | 3.23 | 25.2 | 95.4 |

The flowabilities of the powder mixtures of the present invention are more than 5 sec/50 g smaller (better than those of the simple powder mixtures; thus their flowabilities are improved.

PRACTICAL EXAMPLE 6

A powder mixture (Practical Example 15) was produced by adhering 1% by weight natural graphite powder having a mean particle diameter of 16 μm and 0.75% by weight talc powder having particle diameters of 44 μm or less to the surface of atomized iron powder for powder metallurgy having a mean particle diameter of 78 μm by using a melted-together binder composed of 1% by weight zinc stearate and 0.19% by weight oleic acid; another powder mixture (Practical Example 16) was produced by adhering 2.5% by weight natural graphite powder having a mean particle diameter of 16 μm and 1.5% by weight ferrophosphorus powder having a P content of 20% by weight and particle diameters of 44 μm or less to the surface of the same iron powder by using a melted-together binder composed of 1% by weight zinc stearate and 0.19% by weight oleic acid.

Furthermore, for comparison, powder mixtures were produced with the same compositions as in Practical Examples 15 and 16, but by the ordinary powder mixed method (Comparative Examples 14 and 15). The mixtures with talc added were analyzed for Si and those with ferrophosphorus powder added were analyzed for P, by the same method as was used for the degree of C adhesion, and the results were taken as the degrees of talc adhesion and P adhesion.

$$\text{Degree of talc adhesion} = \frac{Si \text{ analysis value in } 100 - 200 \text{ mesh}}{Si \text{ analysis value in whole mixture}}$$

$$\text{Degree of } P \text{ adhesion} = \frac{P \text{ analysis value in } 100 - 200 \text{ mesh}}{P \text{ analysis value in whole mixture}}$$

Moreover, the mixtures were sampled at uniform intervals in a two-stage hopper removal test and analyzed to investigate the degrees of segregation of the talc and ferrophosphorus.

Figure 12:
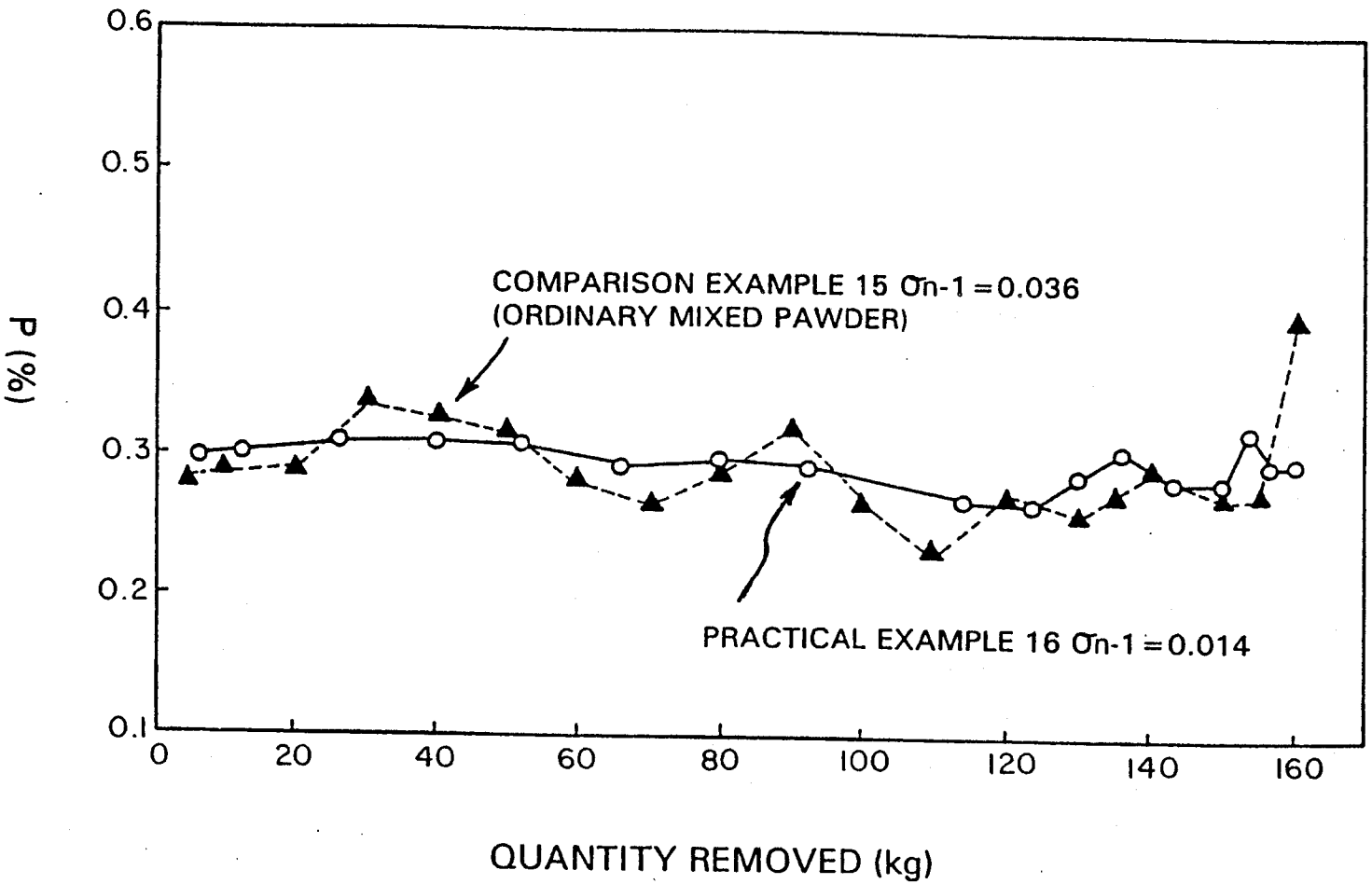
FIG. 12 is a graph which shows the relationship between the amount removed and phosphorus content in the practical examples.
Figure 13:
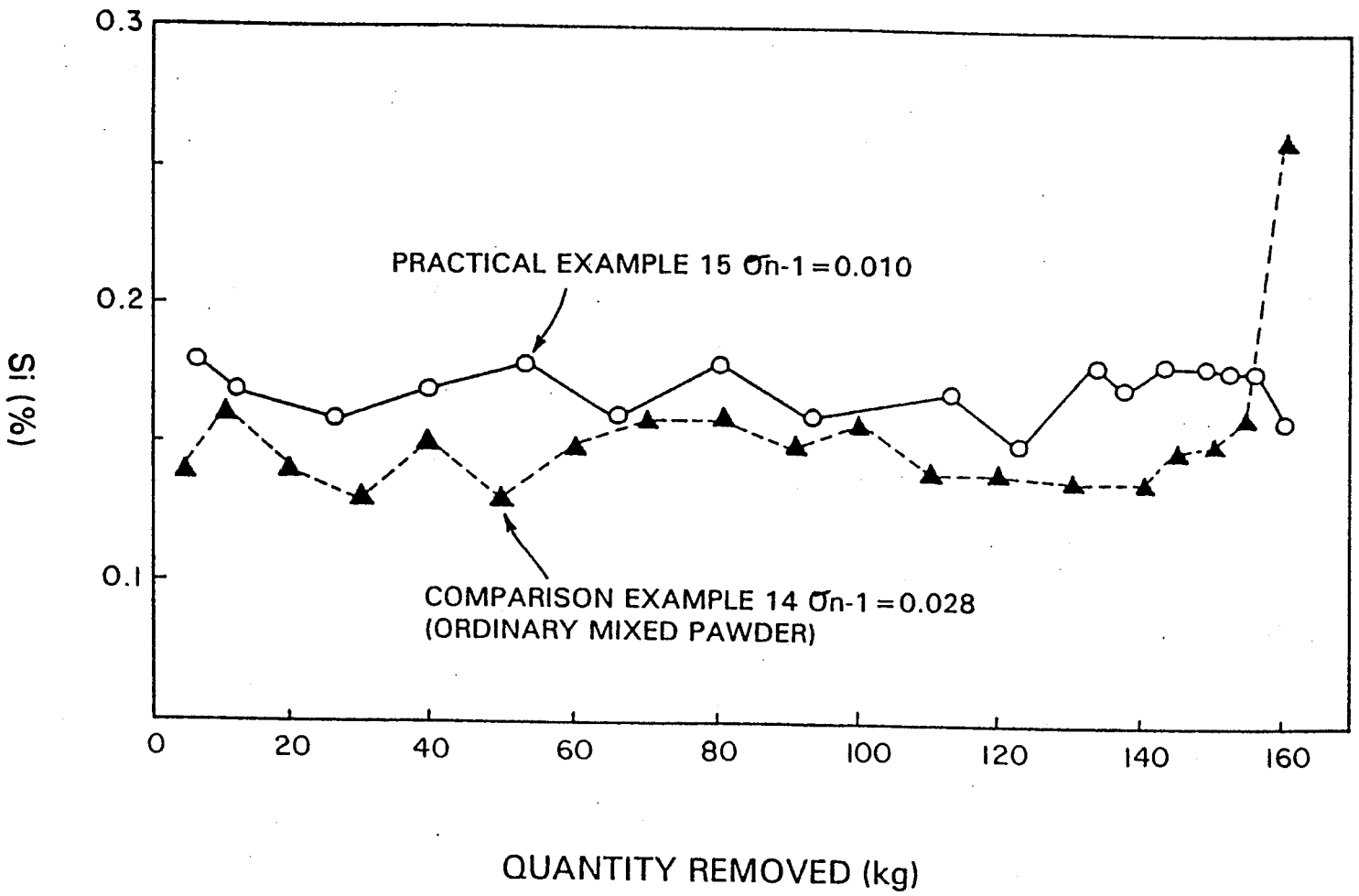
FIG. 13 is a graph which shows the relationship between the amount removed and silicon content in the practical examples.

As can be seen from Table 6 and FIGS. 12 and 13, in Practical Examples 15 and 16 of the present invention both the talc and the ferrophosphorus had much higher degrees of talc and P adhesion than the powder mixtures produced by the ordinary powder mixing method (Comparative Examples 14 and 15), and their standard deviations in the segregation test were also less than half the standard deviations of the powder mixtures produced by the ordinary powder mixing method.

TABLE 6

| Mixing Method | Composition | Degree of talc adhesion (%) | Degree of P adhesion (%) | Flow-ability (sec/50 g) |
|---|---|---|---|---|
| Prac. Ex. 15 | Fe-1% graphite powder-0.75% talc | 81.4 | — | 24.4 |
| Comp. Ex. 14 Ordinary mixed powder g | Fe-1% graphite powder - 0.75% talc | 13.7 | — | No flow |
| Prac. Ex. 16 | Fe-2.5% graphite powder-2% ferrophosphorus powder | — | 37 | 22.5 |
| Comp. Ex. 15 Ordinary mixed powder h | Fe-2.5% graphite powder-2% ferrophosphorus powder | — | 22 | No flow |

This invention was proven to have a strong binding effect, to prevent segregation, and to improve flowability for alloying powders having large differences from ferrous powders as to specific gravity, and for additive powders which greatly affect the properties of the sintered bodies by segregation.

The oleic acid which is a constituent of the melted-together binder of the present invention completely decomposes and volatilizes in the dewaxing process at the time of sintering, and presents no problems whatever during the sintering process.

We claim:

1. An iron base powder mixture for powder metallurgy, comprising a mixture of a ferrous powder and an alloying powder, having such a degree of adhesion that, upon component analysis before and after screening test, the ratio of the amount of said alloying element contained in a 100–200 mesh portion of the said mixture to the amount of the said alloying element in the total mixture is 65% or more.

2. An iron base powder mixture for powder metallurgy, comprising a mixture of a ferrous powder, an alloying powder, and a silicon-containing powder for improving machinability, said powders having such a degree of adhesion that, upon component analysis, each ratio of the amount of the alloying element or Si in a 100–200 mesh portion to the amount of said alloying element of Si in the total mixture is 65% or more.

3. An iron base powder mixture for powder metallurgy in accordance with claim 1, wherein its flowability, as specified in JIS Z 2502-1979, is at least 5 sec/50 g less that the flowability in the case of a simple mixture composed of the same powders.

4. An iron base powder mixture for powder metallurgy in accordance with claim 1, wherein the quantity of accumulated dust generated from the mixture within a measurement time of 240 seconds is 300 counts or less.

5. An iron base powder mixture for powder metallurgy in accordance with claim 1, wherein the density of the green compact when the mixture of claim 1 or 2 is compacted in a die under a pressure of 5 t/cm$^2$ is not reduced more than 0.04 g/cm$^2$ compared to the density of a simple mixture composed of the same powders, using the same kind and quantity of lubricant.

6. An iron base powder mixture for powder metallurgy, comprising an iron based powder and a powder selected from the group consisting of an alloying powder and a powder for improving machinability, wherein the powder is adhered to the surface of the ferrous powder by means of a melted-together binder composed of an oil and a metal soap or wax.

7. An iron base powder mixture for powder metallurgy in accordance with claim 6, in which the weight ratio of the oil which is a constituent of the melted-together binder to the metal soap or wax which is another constituent of the melted-together binder is 0.1–0.4.

8. An iron base powder mixture for powder metallurgy in accordance with claim 6, in which the oil is oleic acid and the metal soap is zinc stearate.

9. An iron base powder mixture for powder metallurgy, which comprises particles of a ferrous powder and particles of an alloying powder which comprises an alloying element, at least some of said particles being adhered together by a with melted-together binder which comprises a metal soap or a wax powder and an oil, the ratio of the amount of said alloying element in a 100–200 mesh fraction of said mixture to the amount of the said alloying element in the total mixture being 65% or more.

10. An iron base powder mixture for powder metallurgy, comprising a mixture of a ferrous powder, an alloying powder and a silicon-containing powder wherein said powders are at least partially adhered together by contact with a melted binder composed of a metal soap or a wax powder and an oil, and wherein the degree of adhesion of the powders is 65% or more when measured as a ratio of the content in a 100–200 mesh sample to the content in the original sample.

* * * * *